US007665826B2

(12) United States Patent
Mukai et al.

(10) Patent No.: US 7,665,826 B2
(45) Date of Patent: Feb. 23, 2010

(54) INKJET PRINTING HEAD AND METHOD OF MANUFACTURING THE SAME

(75) Inventors: Kayo Mukai, Mitaka (JP); Toshio Kashino, Fujisawa (JP)

(73) Assignee: Canon Finetech Inc., Ibaraki (JP)

( * ) Notice: Subject to any disclaimer, the term of this patent is extended or adjusted under 35 U.S.C. 154(b) by 383 days.

(21) Appl. No.: 11/679,637

(22) Filed: Feb. 27, 2007

(65) Prior Publication Data

US 2007/0206064 A1 Sep. 6, 2007

(30) Foreign Application Priority Data

Mar. 3, 2006 (JP) ..... 2006-058414

(51) Int. Cl.
*B41J 2/05* (2006.01)

(52) U.S. Cl. ..... 347/56; 347/65; 347/67

(58) Field of Classification Search ..... 347/20, 347/56, 61–65, 67, 92–94
See application file for complete search history.

(56) References Cited

U.S. PATENT DOCUMENTS

| | | | |
|---|---|---|---|
| 6,151,049 | A | 11/2000 | Karita et al. |
| 6,270,200 | B1 | 8/2001 | Ishinaga et al. |
| 6,328,420 | B1 | 12/2001 | Koyama et al. |
| 6,374,482 | B1 | 4/2002 | Mihara et al. |
| 6,474,791 | B2 | 11/2002 | Ishinaga et al. |
| 6,491,381 | B2 | 12/2002 | Mochizuki et al. |
| 6,523,941 | B2 | 2/2003 | Asakawa et al. |
| 6,595,625 | B2 | 7/2003 | Sugama et al. |
| 6,834,943 | B2 * | 12/2004 | Mihara et al. ..... 347/65 |

FOREIGN PATENT DOCUMENTS

| | | | |
|---|---|---|---|
| EP | 0819 532 | A2 | 1/1998 |
| EP | 0 895 861 | A1 | 2/1999 |
| JP | 63-197652 | A | 8/1988 |
| JP | 10-016243 | A | 1/1998 |

* cited by examiner

*Primary Examiner*—Juanita D Stephens
(74) *Attorney, Agent, or Firm*—Fitzpatrick, Cella, Harper & Scinto

(57) ABSTRACT

Disclosed is an inkjet printing head which ejects ink in response to generation a bubble in the ink accompanying the action of heat from a heater, and which preferably allows ejection energy to be effectively used, and desired attachment accuracy of a movable valve to be secured and maintained. To this end, employed is a two-body structure formed of a substrate including the heater; and a valve retaining member having the movable valve. Then, the effective use of ejection energy is achieved by appropriately selecting the shape and dimensions of the movable valve. Furthermore, the desired attachment accuracy is secured and maintained by attaching the valve retaining member to the substrate by applying a photolithography process without using an adhesive agent.

4 Claims, 16 Drawing Sheets

INKJET PRINTING HEAD AND METHOD OF MANUFACTURING THE SAME

This application claims the benefit of Japanese Patent Application No. 2006-058414 filed Mar. 3, 2006, which is hereby incorporated by reference herein in its entirety.

BACKGROUND OF THE INVENTION

1. Field of the Invention

The present invention relates to an inkjet printing head and a method of manufacturing the inkjet printing head. In particular, the present invention relates to an inkjet printing head using a method in which a state of liquid is changed along with a rapid volume change of the liquid (generation of a bubble) by applying energy such as thermal energy to the liquid, and in which an acting force caused by this change of the state allows ink to be ejected from an ejection opening; and to a method of manufacturing the inkjet printing head.

2. Description of the Related Art

In general, in an inkjet printing head of this type, provided is a liquid path extending towards an ejection opening from an upstream side in an ink supplying direction, and the liquid path is provided with a heater (such as an electrothermal transducer) which generates thermal energy applied to ink. Then, a state of ink on the heater facing the liquid path is changed (film boiling generates a bubble) when the heater is driven, and this change causes a pressure with which ink existing on an ejection opening side from the heater to be ejected. This bubble phenomenon itself, however, does not have any directional characteristics, so that the pressure caused by the bubble affects, in the ink channel, not only on the direction in which the ink is to be ejected, but also on the upstream side in the ink supplying direction. This phenomenon generates energy loss, thereby reduces the amount of the energy which is to effectively contribute to ink ejection, decreases an ink ejection speed, and thus deteriorates printing quality. In addition to the above problems, the pressure towards the upstream side in the ink supply direction causes a delay in an operation to replenish (refill) ink of the amount equivalent to that lost due to the ejection. Thus, the pressure is also a factor to prevent printing speed from being speeded up.

In recent years, a demand for printing an image with a stable printing quality at high speed has been increasing. This demand is particularly apparent for printing apparatuses for industrial applications. Thus, in some cases, employed is the following configuration which aims to increase effective use of energy, and to facilitate a smoother refill operation. In this configuration, a movable member is provided in the liquid path, and the movable member operates as a valve in response to the generation of bubble. Thus, the movable member controls the growth of bubble so that the bubble would not go to the upstream side in the ink supply direction.

In Japanese Patent Application Laid-Open No. 63-197652 (1988) (referred to as JP 63-197652 A, below), disclosed is a configuration in which a valve is integrally formed as a single body by utilizing part of a substrate having a heater formed thereon. JP 63-197652 A also cites another configuration as a conventional example. In this configuration, a printing head includes a structure in which a valve or a member (a valve retaining member) having the valve formed thereon is separated from a member (substrate) having a heater formed thereon, and the valve or the valve retaining member is attached to the substrate in a process later performed. Then, in terms of this configuration, the following problems are described: since it is difficult to form a fine valve, it is not easy to form a fine liquid path; and since the valve is attached to the liquid path by use of an adhesion method or the like, not only does the number of assembly processes increase, thereby leading to an increase in manufacturing costs, but also a reduction in reliability, and instability of ejection performance may be caused depending on the attachment accuracy. Thus, JP 63-197652 A discloses the structure in which the substrate and the valve are previously integrated into a single body, and a method of manufacturing the same in order to solve these problems.

In contrast to this, in FIG. 11 of Japanese Patent Application Laid-Open No. 10-16243 (1998) (referred to as JP 10-16243 A, below), disclosed is a method of manufacturing a printing head having a two-body structure formed of a substrate and a valve retaining member. Specifically, JP 10-16243 A discloses the method in which a supporting member at least having its surface formed of metal is disposed on a substrate including a resistor element (a heater), and in which a metallic separation wall (a valve retaining member) having a movable member is fixed to the substrate by the supporting member. In the embodiment of the invention, a method of bonding and fixing, that is, attaching, the substrate and the separation wall to each other as follows. In this method, supporting members each formed of Au or the like of a stud bump type are respectively embedded into two substantially rear portions of the substrate; a separation wall formed of Ni or the like is positioned and mounted on the supporting members in the two portions; and a metal alloy layer between the supporting member and the separation wall is formed by performing a heat treatment or the like on the supporting member from above the separation wall. In this way, the substrate and the separation wall are bonded and fixed to each other. Furthermore, JP 10-16243 A describes the following effect of this method. To be more precise, although the hardening and shrinkage of an adhesive agent adversely affects the attachment accuracy in a case where the adhesive agent is used, this method makes it possible to prevent this disadvantage from occurring.

Both JP 63-197652 A, and JP 10-16243 A intend to achieve an efficient use of energy for ink ejection, and a smoother refill operation, but employ the different basic configurations of the printing heads for achieving these purposes. Specifically, while the printing head disclosed in JP 63-197652 A employs the structure in which the substrate and the valve retaining member are integrally formed in advance (hereinafter, termed as a single-body structure), the printing head disclosed in JP 10-16243 A employs the structure in which the substrate and the valve retaining member each being formed as a separate member are adhered to each other (hereinafter, termed as a two-body structure).

As a result of a dedicated examination made by the inventors of the present invention on these structures, the inventors have obtained the following findings.

Specifically, first, in JP 63-197652 A, in a process of manufacturing the member of the aforementioned single body structure, a layer made of a predetermined material (polysilicon in JP 63-197652 A) is formed on a substrate, and then a portion which is to become a valve is superposed on the layer. Thereafter, the layer existing on a liquid path portion below the valve is etched. Thus, since the etching needs to be carried out in an area below the valve from the periphery of the valve, it is necessary to have some space in the periphery portion of the valve except a portion of the valve to be supported in a cantilevered manner, in order to allow the etching process to be carried out. Specifically, dimensions or a shape of the valve is limited when the etching process is taken into consideration. For this reason, desired dimensions of the valve, that is, a project area of the valve to the heater becomes small. Thus, there is a concern that the effective use of ejection energy, and a smoother refill operation, which are the desired objects, may not be achieved to a sufficient extent. This concern may particularly become a problem in a case where used is a printing head or a printing apparatus for industrial applications of which a stable ejection operation at high speed is strictly required.

Accordingly, it is strongly preferred that a valve having dimensions or a shape which is suitable for the desired objects be formed. Thus, it is advantageous to employ the two-body structure from a viewpoint of design and manufacturing. In this case, however, the problems recognized in JP 63-197652 A, that is, the reduction in reliability, the instability of ejection performance, and the like due to a decrease in the attachment accuracy of the valve retaining member need to be solved appropriately, as a matter of course.

Here, the attachment accuracy of the valve retaining member needs to be secured by attaching the valve retaining member without having undesirable warpage or lifting with respect to the substrate. However, in a case where the valve retaining member and the substrate are caused to adhere to each other in processes of applying a liquid adhesive agent, and then of curing the adhesive agent by heating, various problems to be described below occur.

Firstly, when the number of points where the adhesive agent is to be applied is small, the undesired warpage or lifting cannot be suppressed effectively. Moreover, since the adhesion strength between the substrate and the supporting member is weak, there is a concern that the valve retaining member may be separated from the substrate due to the flow of ink.

In a case where the number of the application points and the amount of the adhesive agent to be applied are increased in order to solve these problems, the adhesive agent flows from the application point to the periphery thereof, and therefore the drops of the adhesive agent on the neighboring application points are connected to each other. This is because the adhesive agent is in a liquid state when being applied thereto. As a result of this, the valve retaining member and the substrate become in a state where they adhered to each other in a contiguous wide area (all over the surface in the extreme case) with the adhesive agent. In this case, a large amount of stress is generated on the adhesion interface by heating in the process of curing the adhesive agent, or by thermal influence occurring along with a printing operation. Specifically, the stress is generated in the adhesion portion due to curing and shrinkage of the adhesive agent, or a difference between the linear expansion coefficients of the adhesive agent and the substrate. This stress may generate a fine crack in the substrate. In general, the substrate is provided with a wiring of aluminum or the like for selectively driving the heater, so that an electrical short may occur when ink flows into the crack which has been generated. Moreover, an excessive amount of the adhesive agent applied thereto may inhibit ink from flowing in the printing head or the liquid path.

Furthermore, a metering discharge device (a dispenser) is used in general for the purpose of applying a predetermined amount of an adhesive agent to a desired position, but a shape of the applied adhesive agent cannot be accurately controlled by use of the metering discharge device. Accordingly, this produces a difference among the shapes of the drops of the adhesive agent after cured at the respective applied positions, and thereby generates a variation in the fixation state of the valve retaining member. Thus, it becomes extremely difficult to maintain a stable adhesion state, that is, the stable attachment accuracy.

In contrast to this, the method disclosed in JP 10-16243 A employs a structure in which, with application of a bonding technique, the valve retaining member is joined to the substrate with the supporting members provided on the two rear portions on the substrate. In such a configuration, problems related to the curing of the adhesive agent or the like do not occur. As in the case of using an adhesive agent, however, the warpage or lifting may not be suppressed effectively. Thus, there is a concern that the valve retaining member may be separated from the substrate.

SUMMARY OF THE INVENTION

The present invention has been made by taking the problems described above into consideration. An object of the present invention is to realize an arrangement of a valve which can preferably achieve effective use of ejection energy and a smoother refill operation by employing a two-body structure formed of a substrate and a valve retaining member; and to make it possible to secure and maintain desired attachment accuracy by attaching the valve retaining member to the substrate in good conditions.

In a first aspect of the present invention, there is provided an inkjet printing head comprising: a substrate including a heater for causing thermal energy used for ejecting ink from a nozzle to act on the ink; and a valve retaining member including a movable valve which is provided corresponding to the nozzle, and which is capable of changing its position in response to generation a bubble in the ink accompanying the action of the thermal energy caused by the heater, wherein the substrate includes a seat to which the valve retaining member is attached, the valve retaining member includes a hole penetrating from a bottom surface attached to the seat, and to a top surface opposite the bottom surface, and the valve retaining member is fixed to the substrate by an adhesion portion formed by attaching a material having a thermal expansion coefficient equal to that of the seat so that the material is joined to the seat by passing through the hole from the top surface.

In a second aspect of the present invention, there is provided a method of manufacturing an inkjet printing head including: a substrate having a heater for causing thermal energy used for ejecting ink from a nozzle to act on the ink; and a valve retaining member having a movable valve which is provided corresponding to the nozzle, and which is capable of changing its position in response to generation a bubble in the ink accompanying the action of the thermal energy caused by the heater, the method comprising the steps of: arranging the valve retaining member having a through hole on a seat being provided on the substrate; and fixing the valve retaining member to the substrate by applying a photolithography process, by forming an adhesion portion which passes through the hole from a top surface of the valve retaining member and is joined to the seat.

According to the present invention, the shape and dimensions of the movable valve can be appropriately selected by adapting, as a basic structure, the two-body structure formed of the substrate and the valve retaining member. Thereby, the effective use of ejection energy as well as the smoother refill operation can be achieved. Moreover, the valve retaining member is fixed to the substrate with the adhesion portion formed by adhering a material having a thermal expansion coefficient equal to that of the seat in a way that the material passes through the hole from the top surface of the valve retaining member, and is joined to the seat. Thus, desired attachment accuracy can be maintained without an occurrence of an undesired stress due to thermal influence. Furthermore, by attaching the valve retaining member to the substrate by applying the photolithography process without using an adhesive agent, the desired attachment accuracy can be secured and maintained.

Further features of the present invention will become apparent from the following description of exemplary embodiments (with reference to the attached drawings).

DESCRIPTION OF THE EMBODIMENTS

Hereinafter, an embodiment of the present invention will be described in detail with reference to drawings.

Figure 1:
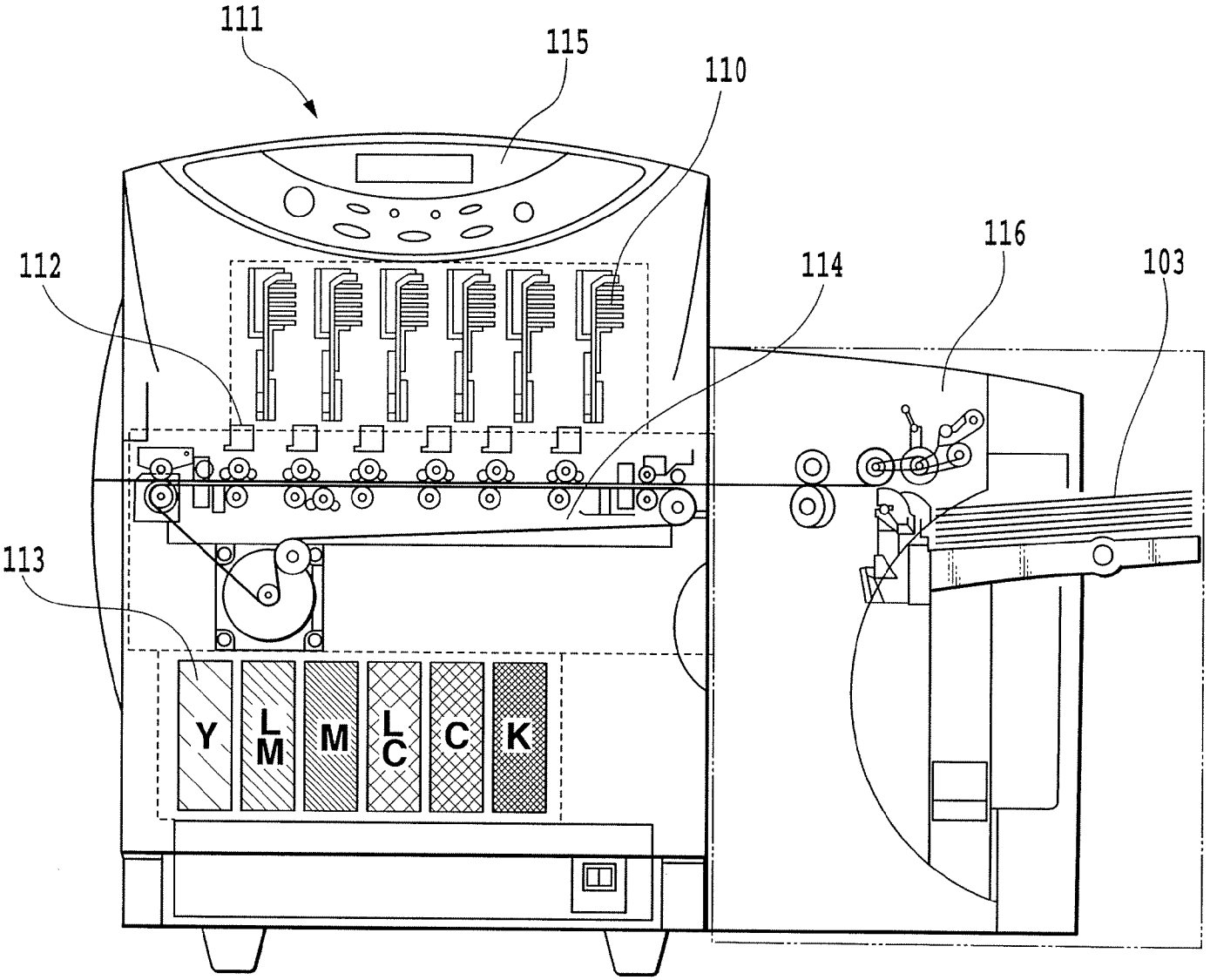
FIG. 1 is a front view schematically showing an internal structure of a printing apparatus provided with a printing head according to an embodiment of the present invention.

FIG. 1 is a front view schematically showing an internal structure of a printing apparatus 111 provided with printing heads 110 according to an embodiment of the present invention.

In FIG. 1, the printing apparatus 111 is configured of the plurality of printing heads 110, individual recovery units 112 each corresponding to each of the printing heads 110, ink tanks 113 of cartridge type each for storing ink therein, a delivery unit 114, an operation panel 115, and a sheet feeder 116 for supplying a printing medium 103 to the main body of the printing apparatus.

Figure 2:
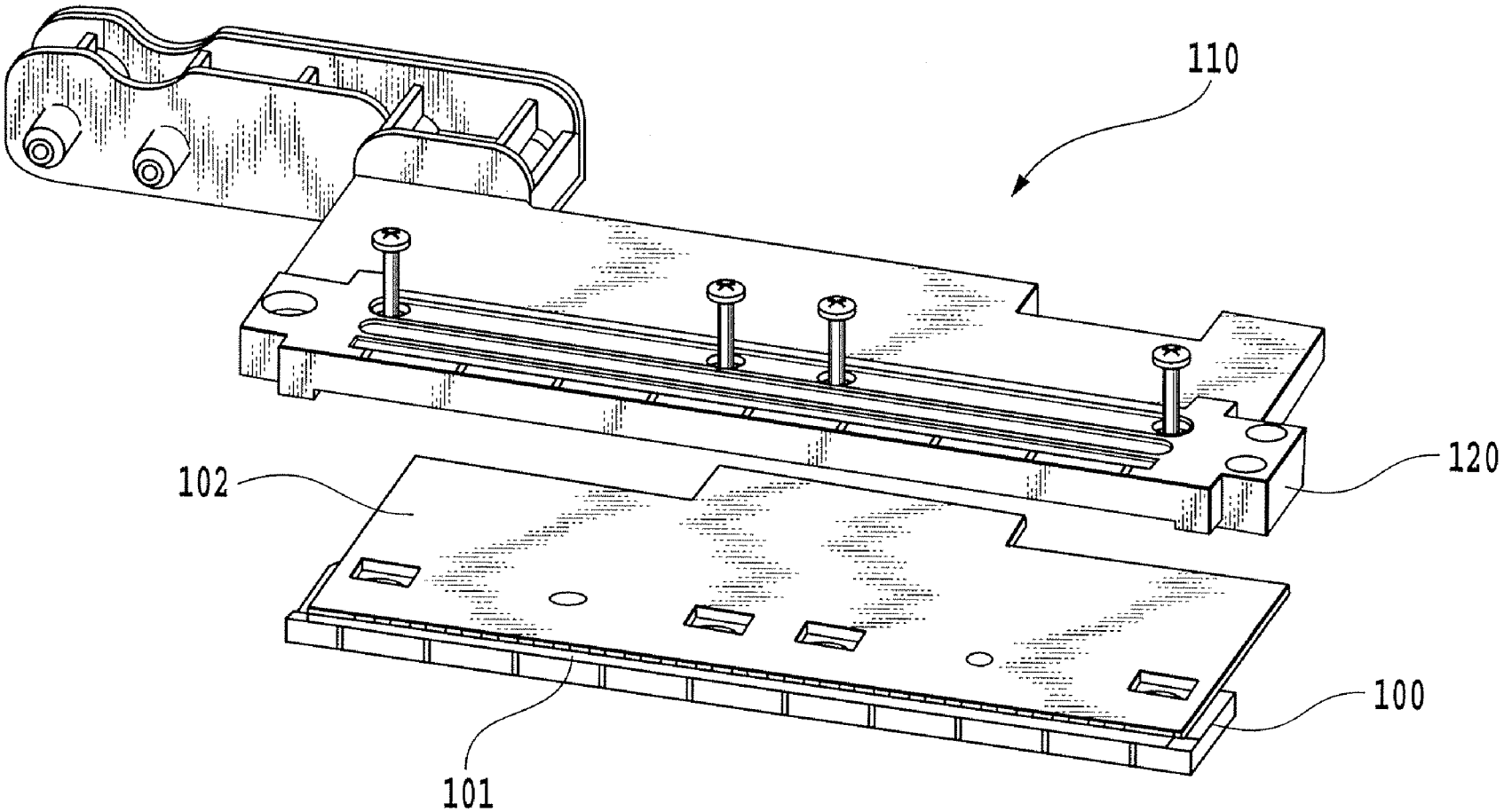
FIG. 2 is an exploded perspective view of the printing head according to the embodiment of the present invention.

FIG. 2 is a perspective view showing the printing head 110 in a state of being exploded.

In FIG. 2, reference numeral 101 denotes an ejection element constituting a main part of the printing head 110. One side surface of the ejection element 101 is supported by a base plate 100 made of ceramic. A wiring substrate 102 is arranged on the opposite side surface of the ejection element 101. The wiring substrate 102 is electrically connected by wire bonding to wirings of electrode portions (for heaters or driving elements) provided on the ejection element 101.

An ink channel forming member denoted by reference numeral 120 is provided for transferring ink to the ejection element 101, and is connected, through an opening provided in the wiring substrate 102, to a common liquid chamber 16 (to be described later) provided in the ejection element 101. An ink system of the present embodiment constitutes a circulating system between the printing heads 110 and the ink tanks 113. Specifically, ink is transferred from each of the ink tanks 113 through the ink channel forming member 120 to the common ink chamber 16 in the ejection element 101. Then, the transferred ink is distributed to each of the nozzles from the common liquid chamber. On the other hand, the ink is circulated from the common ink chamber of the ejection element 101 to each of the ink tanks 113 through the ink channel forming member 120.

Figure 3:
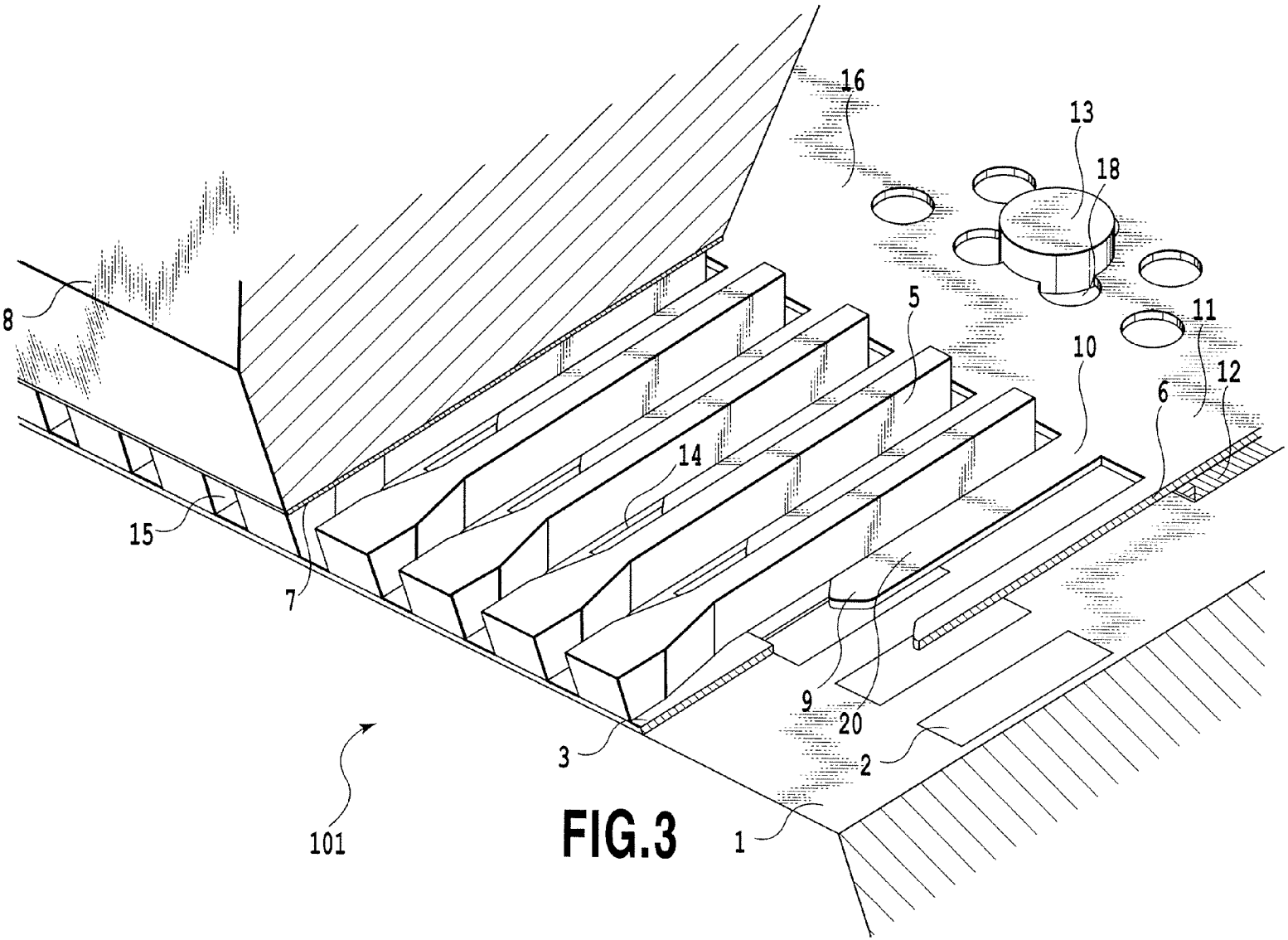
FIG. 3 is a cutaway perspective view showing the vicinity of nozzles of an ejection element, which is a constituent element of the printing head according to the embodiment of the present invention.

FIG. 3 is a cutaway perspective view showing the vicinity of the nozzles of the ejection element 101 of the printing head according to the embodiment. On a heater board 1, a plurality of heaters 2 such as electrothermal transducers are provided at positions each corresponding to each of the nozzles 14. The heater 2 is used for generating a bubble in ink by heating the ink. A resistor element of tantalum nitride or the like having a thickness from 0.01 μm to 0.5 μm, and a sheet resistance of 10 to 300 O per square is used for the heater 2. It should be noted that the heater 2 may be formed of a material other than tantalum nitride such as hafnium boride, for example. Moreover, the thickness or the sheet resistance of the heater 2 is not particularly limited.

A pair of electrode wirings (not shown) made of aluminum or the like for conducting electricity are connected to both ends of each of the heaters 2. In addition, a switching transistor (not shown) for turning on/off electricity is provided to one of the electrode wirings. In accordance with a printing signal inputted from an outside of the printing head 110, a controller IC formed of a circuit including a gate element or the like controls the driving of the switching transistor.

A nozzle side wall 5 is formed between each of pairs of the adjacent heaters 2 on the heater board 1. Moreover, a top plate 8 formed of Si or the like is disposed on the top surfaces of the nozzle side walls 5 with a top plate adhesive layer 7 interposed therebetween. The top plate adhesive layer 7 has a thickness of 2 μm or the like. Thereby, formed are the nozzles 14 each having a tubular shape, and each being surrounded by the heater board 1, the nozzle side walls 5, and the top plate adhesive layer 7. In addition, a nozzle reinforcing wall 3 having a thickness of approximately 5 μm to 10 μm is formed on the heater board 1 at an ejection opening 15 side of all of the nozzles 14. The top plate 8 is provided with an opening (not shown) formed by anisotropic etching or the like. Accordingly, by connecting the aforementioned ink channel forming member 120 to the opening, ink or the like can be introduced into the common liquid chamber 16.

A valve retaining member 11 is disposed on the heater board 1 with a valve seat 12 interposed therebetween. The valve retaining member 11 is formed in a shape which supports, in a cantilevered manner, movable valves 6 each corresponding to each of the nozzles 14. Then, the valve retaining member 11 is arranged in a way that free ends 9 of the movable valves 6 extend in the direction toward the ejection openings, and movable valve supporting points 10 are positioned inside the common liquid chamber 16. A plurality of holes 18 dispersed appropriately are provided on the valve retaining member 11. Then, the valve retaining member 11 is joined to the valve seat 12 by forming an adhesion column 13 through some of the holes 18.

In the structure described so far, in accordance with a printing signal inputted from an outside of the printing head, the controller IC controls the driving of the switching transistor, and thereby, electricity for the heater 2 is turned on/off. Ink supplied to each of the nozzles 14 from the common liquid chamber 16 is heated on the heater 2, and then a bubble is generated in the ink. When the bubble in the ink start to be generated, each of the movable valves 6 also changes the positions along with this generation of bubble. Thus, by causing a pressure of the bubble to act on effectively, the movable valve 6 facilitates the flow of the ink towards the ejection opening direction. Thereafter, as the pressure generated in the bubble reduces, the bubble also shrink. As a result, an ink droplet out of the ejection opening is separated therefrom, and then ejected.

A method of manufacturing an ejection element constituting a main part of a printing head will be explained with reference to FIGS. 4A and 4B, and FIGS. 5A to 13. FIGS. 4A to 12A are diagrams viewed from an ejection portion side of the printing head. FIGS. 4B to 12B are cross sectional diagrams along a longitudinal direction of the nozzles. It should be noted that in the present embodiment, two pieces of the ejection element are manufactured as a single body, and then that the single body is cut at the plane indicated by the dashed-dotted line in FIGS. 4B to 12B, thus producing each piece of the ejection element. The ejection openings appear on the cut planes. Incidentally, the method of manufacturing the ejection element is not limited to this, and a method of manufacturing a single unit of an ejection element may be employed.

Figure 4B:
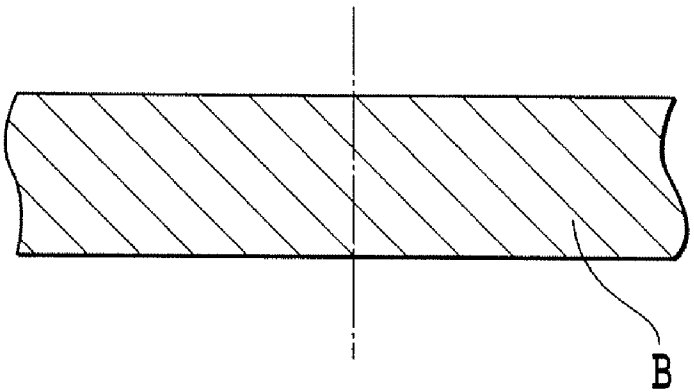
FIGS. 4A and 4B, and FIGS. 5A through 13 are schematic diagrams for explaining a manufacturing process of the ejection element shown in FIG. 3.
Figure 4A:
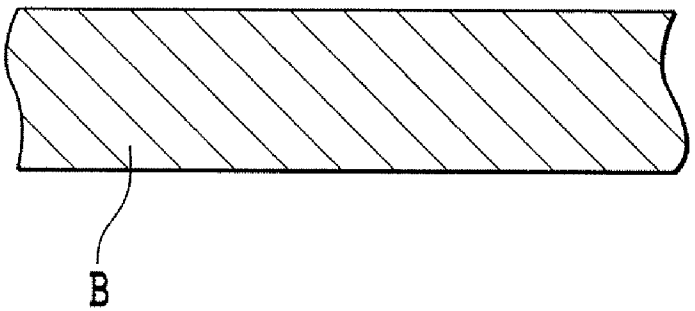

By use of the same manufacturing equipment as one used in manufacturing processes of semiconductor devices, the heaters 2 formed of hafnium boride, tantalum nitride, or the like are formed on an element substrate B made of a silicon wafer shown FIGS. 4A and 4B. Incidentally, as the element substrate B, an element substrate may be used in which a drive circuit formed of a semiconductor device such as a switching transistor for selectively driving the heaters 2 is prepared in advance. In addition, for the purpose of improving adhesion to a photosensitive resin film in the next manufacturing step, the front surface of the element substrate B is cleaned, and the front surface is modified by using ultraviolet-ozone, or the like. Thereafter, the aforementioned modified surface is spin-coated with a solution which contains a silane coupling agent one percent by weight, and which is prepared by diluting with ethyl alcohol.

Figure 5B:
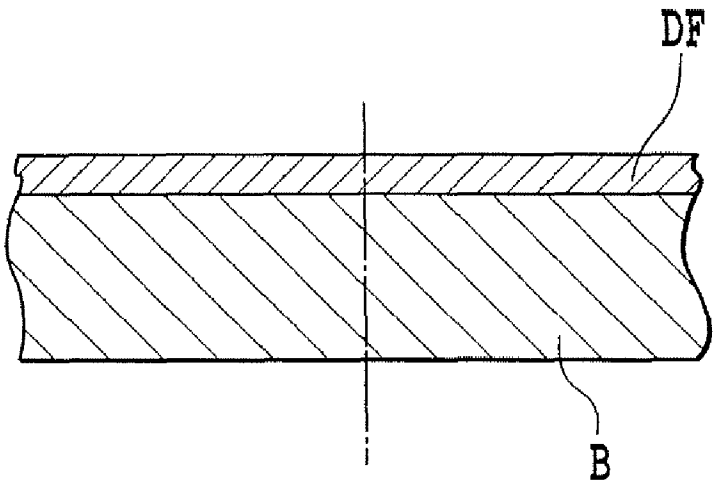
Figure 5A:
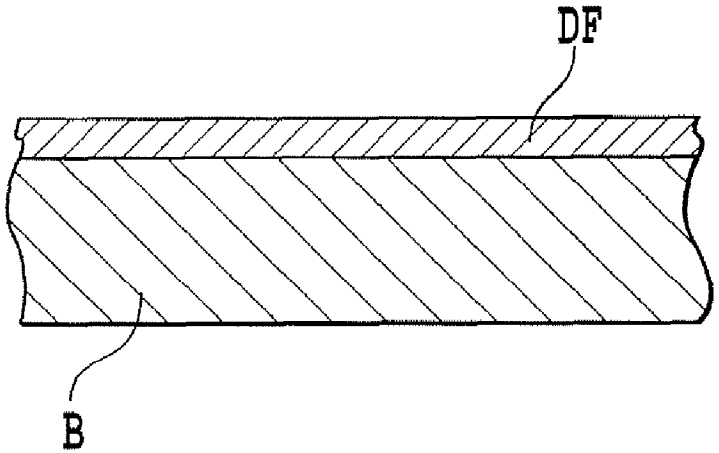

Next, the surface is cleaned, and then, as shown in FIGS. 5A and 5B, a photosensitive resin film DF is laminated on the element substrate B, the adhesion of which has been improved.

Figure 6B:
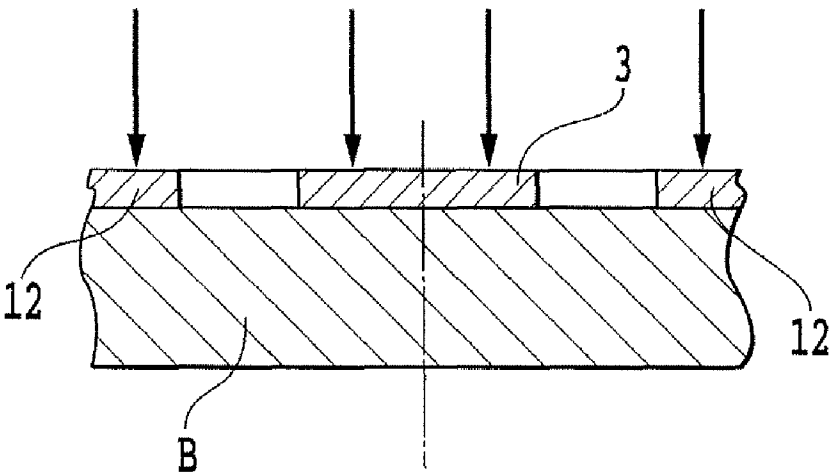
Figure 6A:
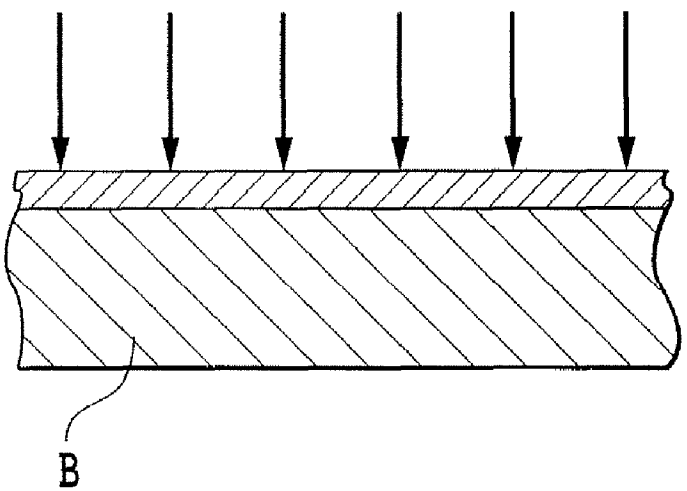

Next, as shown in FIGS. 6A and 6B, portions of the photosensitive resin film DF, which are to be left as the valve seats 12 for adhering the valve retaining members 11 and the nozzle reinforcing walls 3, are irradiated with ultraviolet rays by using a photomask.

Figure 7B:
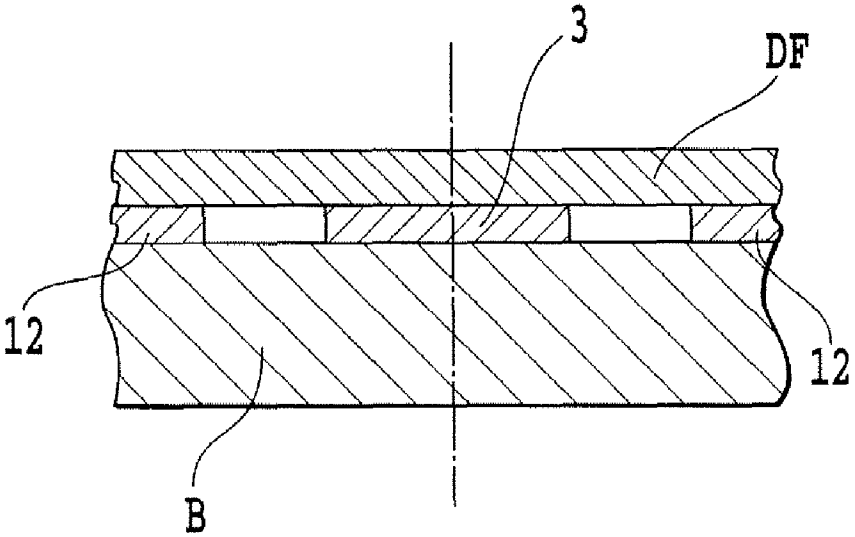
Figure 7A:
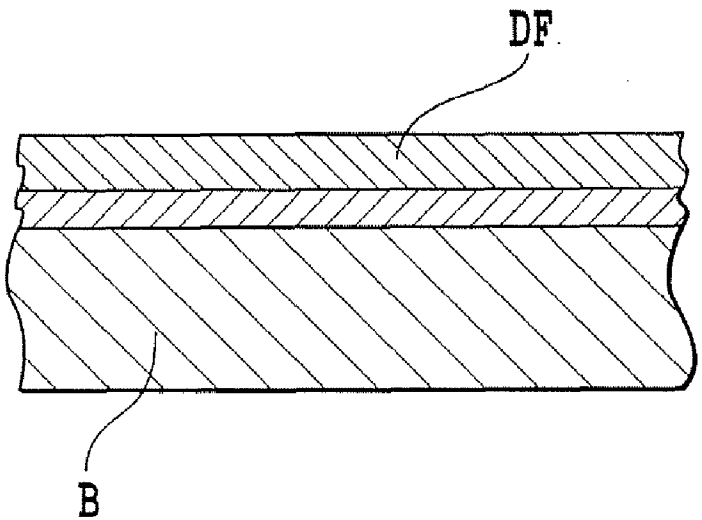

Then, in the next process, as shown in FIGS. 7A and 7B, a photosensitive resin film is further laminated thereon.

Figure 8B:
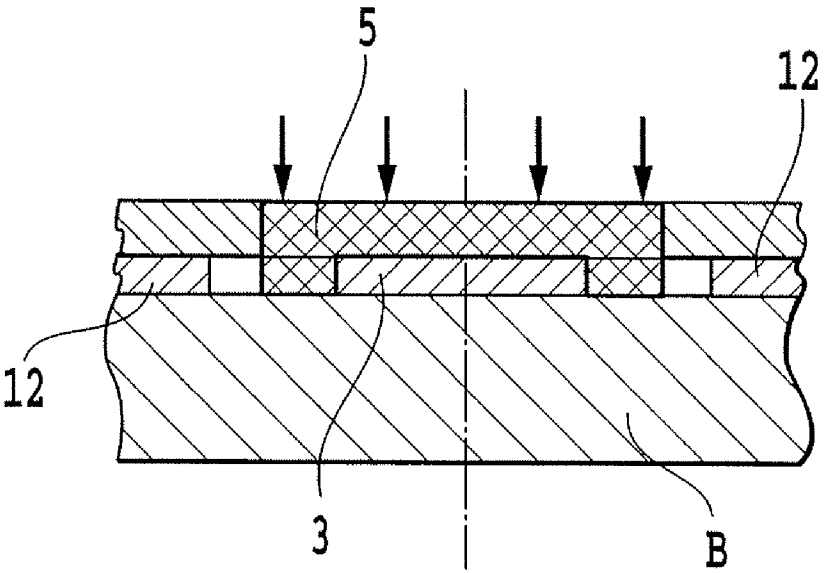
Figure 8A:
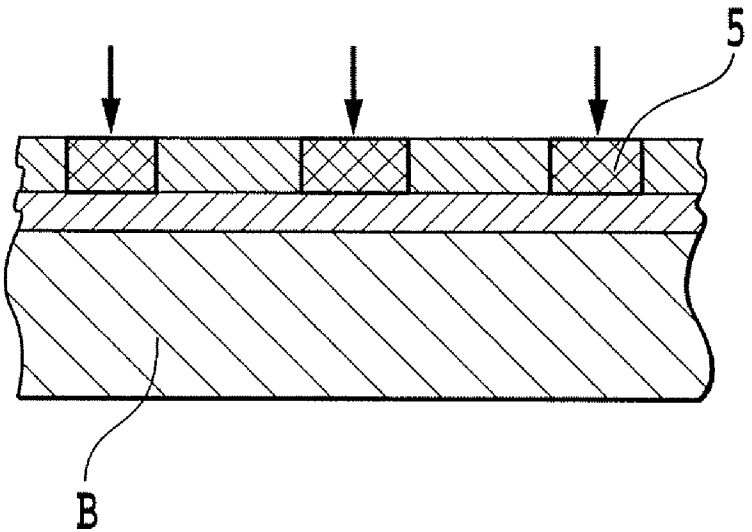

Subsequently, as shown in FIGS. 8A and 8B, a photomask is arranged on this laminated photosensitive resin film, and then, portions of the laminated photosensitive resin film, which are to be left as the nozzle side walls 5, are irradiated with ultraviolet rays by using the photomask.

Figure 9B:
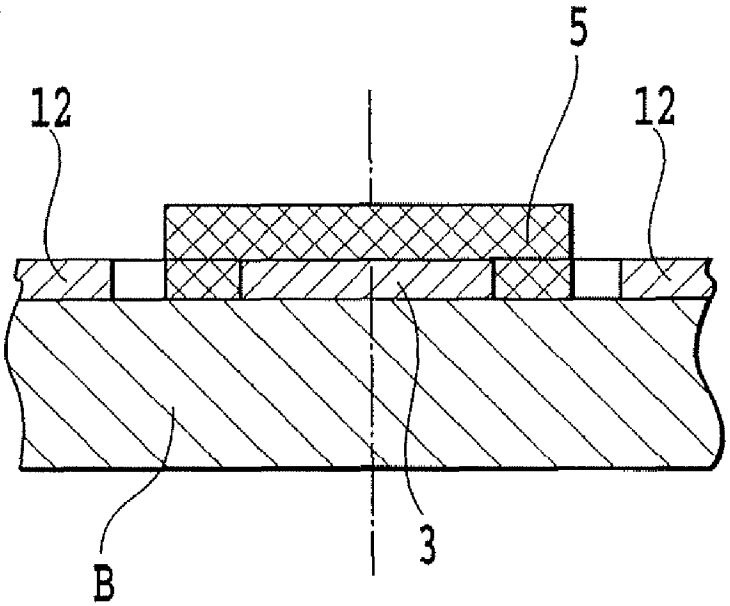
Figure 9A:
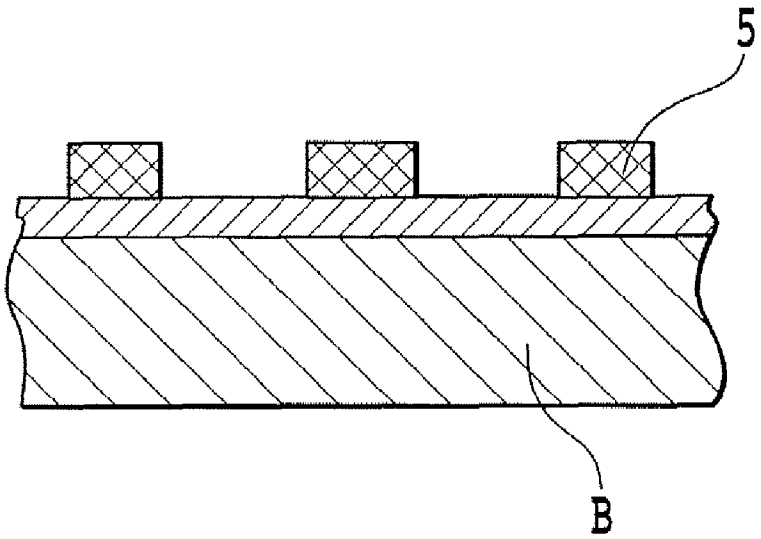

Next, as shown in FIGS. 9A and 9B, the photosensitive resin film is developed with a mixture of xylene and butyl-cellosolve acetate. Then, by causing unexposed portions of the photosensitive film to melt, the nozzle reinforcing walls 3, the nozzle side walls 5, and the valve seats 12 are formed of the thus exposed and cured portions on the element substrate B.

The valve retaining member 11 is adhered to the valve seats 12. Here, the valve retaining member 11 is produced in the process to be described next. Specifically, a photosensitive resin film is laminated on a substrate wafer serving as a base member, first. Then, a pattern is created on the wafer through exposure and development of the photosensitive resin film. By use of this, Ni is grown on the wafer by electroforming so as to have a thickness of approximately 5 μm. Thereafter, by causing the pattern to melt, the valve retaining member having a movable valve is formed on the wafer. The valve retaining member is removed from the wafer, and thus, the valve retaining member 11 is completed.

By producing the valve retaining member through the process described above, the forming of a fine valve becomes possible, and this means that one of the problems in JP 63-197652 A is overcome. Thus, the forming of the fine valve can contribute the formation of a fine liquid path (a nozzle). Furthermore, by producing the valve retaining member as a separate element from the substrate, it is possible to form a valve having dimensions and a shape which correspond to the desired objects.

Figure 10B:
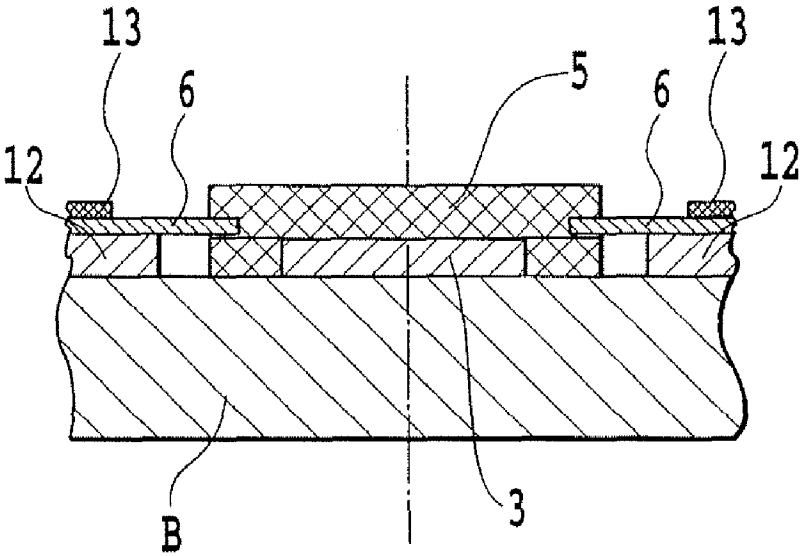
Figure 10A:
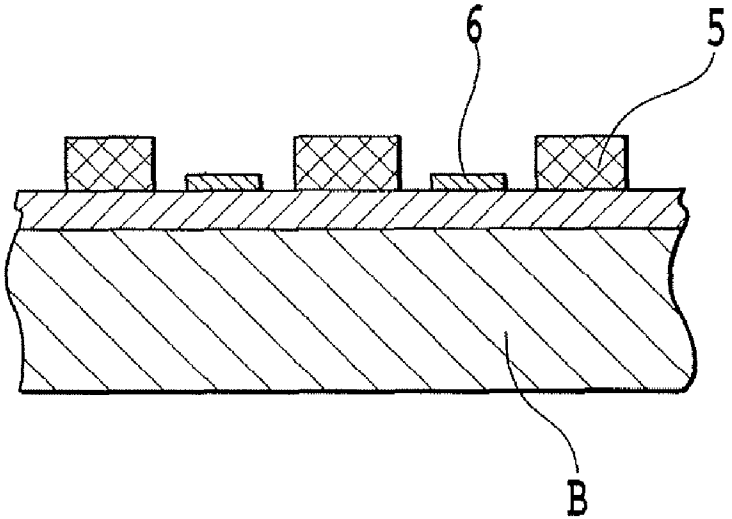

After forming the nozzle side walls 5, the valve retaining members 11 are fixed to the valve seats 12 by the adhesion columns 13 as shown in FIGS. 10A and 10B. The adhesion process will be described later.

Figure 11B:
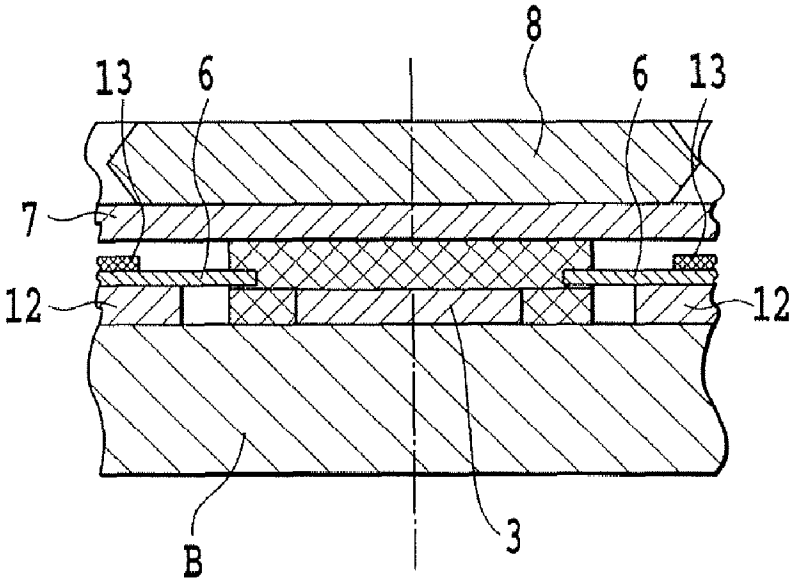
Figure 11A:
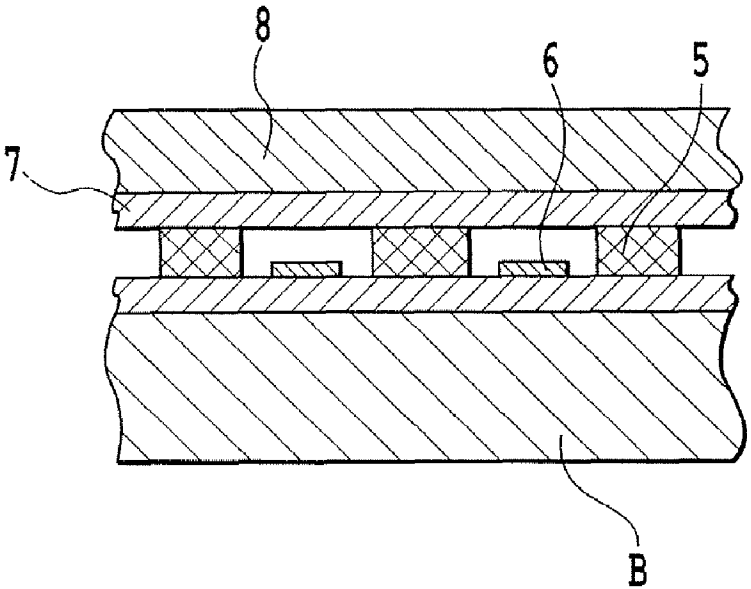

Next, as shown in FIGS. 11A and 11B, the top plate 8 which is previously laminated with the top plate adhesion layer 7 is adhered on the nozzle side walls 5. At this time, a curing process at a temperature of approximately, 200° C. needs to be performed.

Figure 12B:
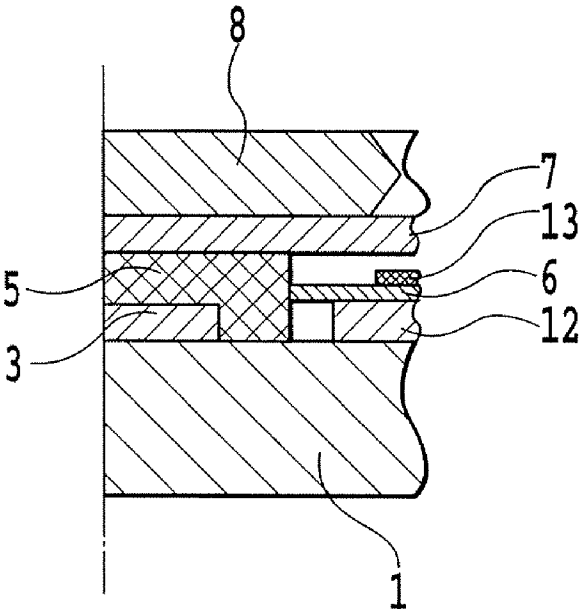
Figure 12A:
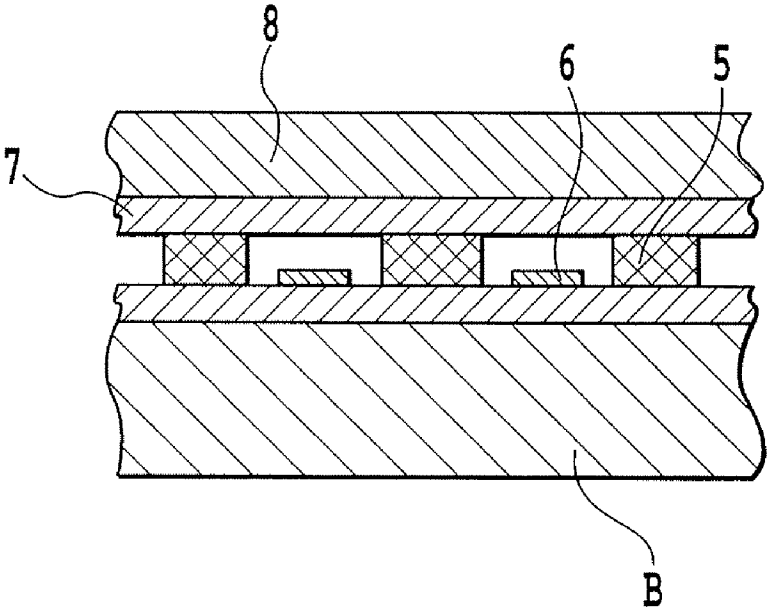

Then, the resultant element substrate manufactured through the processes described so far is cut at an plane (a plane indicated by dashed-dotted line) where the ejection openings abut on each other, and thus is separated into two pieces of the ejection element. Specifically, the resultant element in the state shown in FIGS. 11A and 11B are cut, and then, separated from each other as shown in FIGS. 12A and 12B, by use of a dicing machine to which a diamond blade having a thickness of 0.05 mm is attached, for example.

Figure 13:
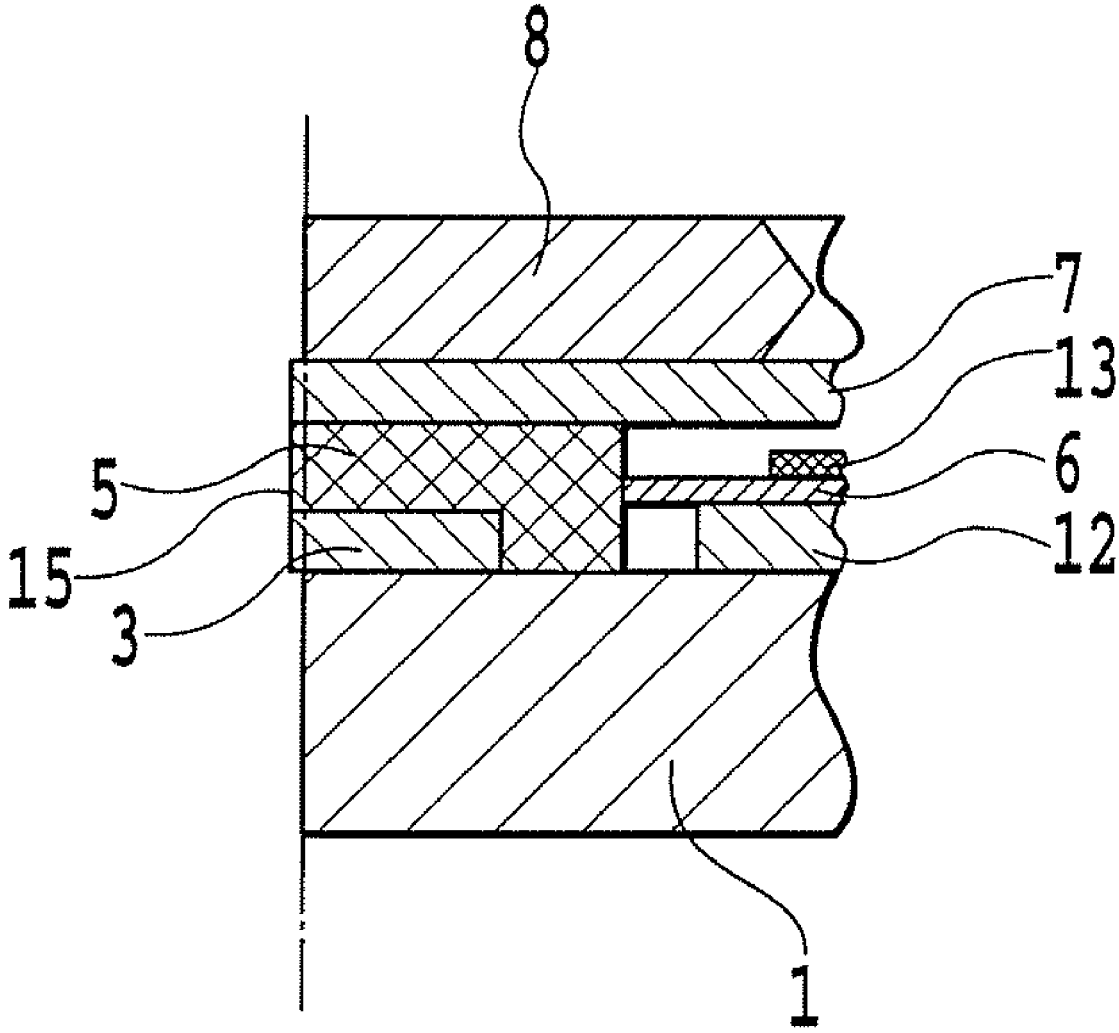

Next, in order to smooth the cut surfaces, the cut surfaces of the pieces of the ejection element formed when the resultant element substrate is separated are grinded while applying a constant pressure thereto. Elasticity of the resin member forming the periphery of the ejection opening is high in comparison with the element substrate B, which is the reference member when the resultant element substrate is cut. For this reason, a given amount of the resin member of the periphery of the ejection opening protrudes from the cut plane as shown in FIG. 13 by releasing the pressure during the processing after the grinding process. Thereby, the periphery of the ejection opening 15 is to be formed of the same member.

Next, a method of adhering the valve retaining member 11, which is a main portion of the present embodiment, to the valve seats 12 on the heater board 1 will be described.

Figure 14C:
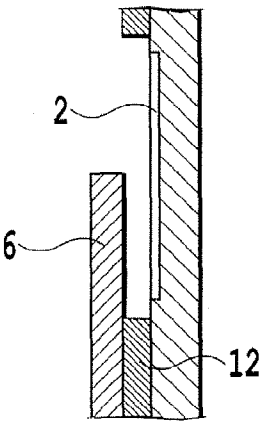
FIG. 14C is an enlarged view of the portion XIVC of FIG. 14B.
Figure 14B:
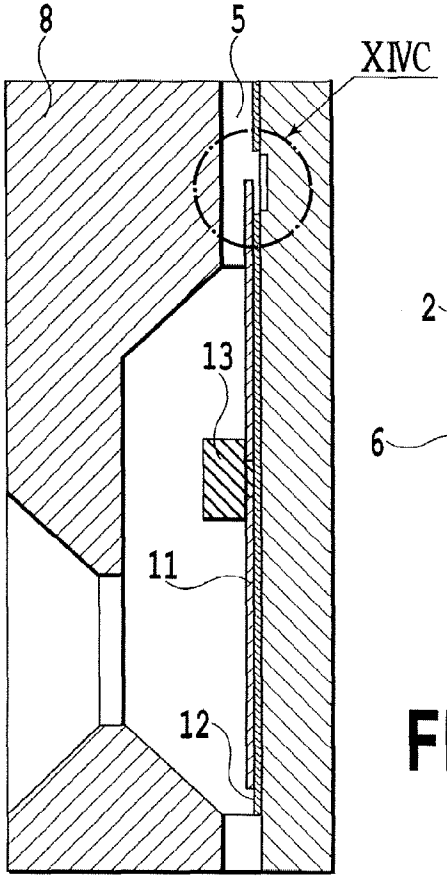
FIG. 14B is a cross sectional view of the printing head taken along the line XIVB-XIVB of FIG. 14A.
Figure 14A:
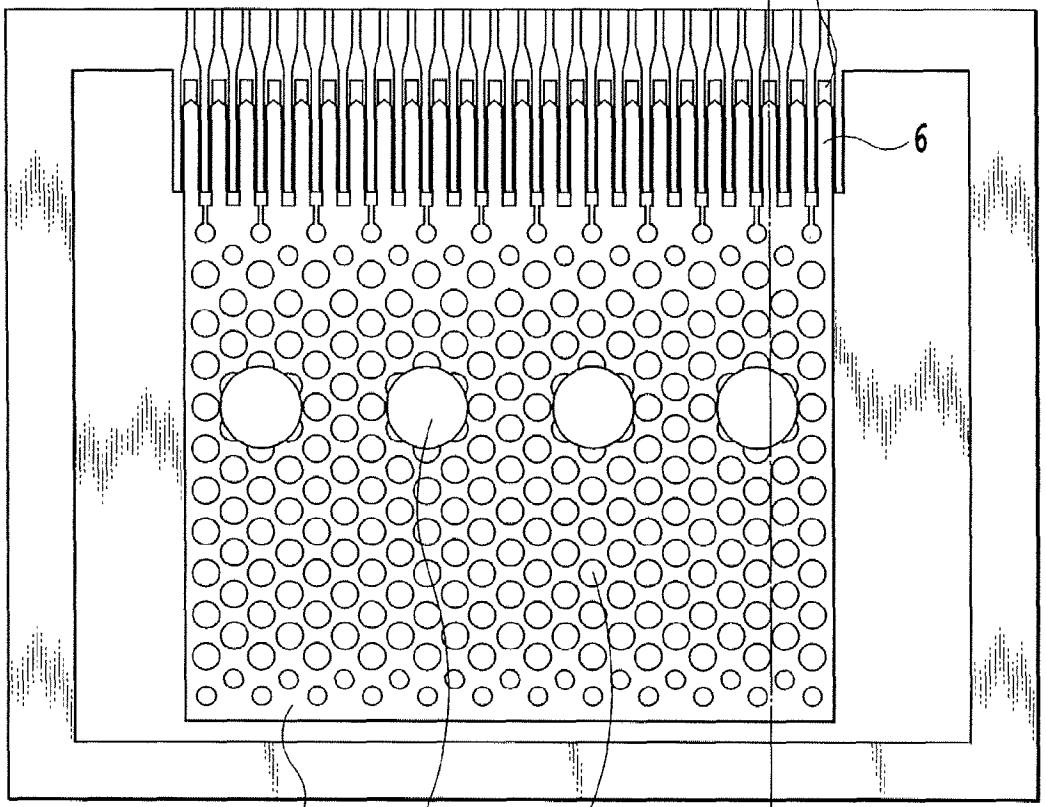
FIG. 14A is a top view showing the printing head according to the embodiment in a state where a top plate is removed therefrom.

FIG. 14A is a top view showing the printing head according to the embodiment in a state where the top plate is removed therefrom. FIG. 14B is a cross sectional view of the printing head taken along the line XIVB-XIVB of FIG. 14A. FIG. 14C is an enlarged view of the portion XIVC of FIG. 14B.

In the present embodiment, as shown in FIG. 14A, the plurality of holes 18 each having a circular shape are formed to pass through the top surface and the bottom surface of the valve retaining member 11. The dimensions of each hole 18 and a distribution state of the holes 18 are appropriately determined.

Here, the movable valves 6 have to operate smoothly by following ejection frequencies at the time of high speed printing. Specifically, the movable valves 6 need to change their positions by using the pressure caused by the bubble generation, and then, need to return to the original positions promptly after a predetermined amount of ink is ejected. However, irregularity in ejection may occur in a case where a sympathetic vibration occurs in the movable valves 6. The sympathetic vibration is generated by a vibration which occurs when the bubble shrinks, and which is transmitted to the movable valve 6. For this reason, in this embodiment, by configuring the valve retaining member 11 to include the plurality of holes 18 which are appropriately distributed, vibrational components are dispersed, and thereby the transmission of the vibration is suppressed to a large extent.

This configuration of the valve retaining member 11 is also preferable in securing and maintaining the attachment accuracy. In the aforementioned manufacturing processes, for example, when the top plate 8 is adhered to the nozzle side walls 5, it is necessary to perform the heating process at a temperature of approximately 200° C. Moreover, the printing head of the present embodiment employs the method of ejecting ink by utilizing thermal energy. For this reason, the valve retaining member 11 may expand due to the heat, and may be distorted. Then, this distortion may adversely affect the attachment accuracy with which the valve retaining member 11 is fixed to the valve seats 12 on the heater board 1. In this embodiment, however, by configuring the valve retaining member 11 to include the plurality of holes 18 which are appropriately distributed, it is possible to relax the thermal expansion.

In this embodiment, then, the valve retaining member 11 is adhered to the valve seats 12 by using some of the plurality of holes 18 distributed in the valve retaining member 11, and by applying a photolithography process. The process of this adhesion is performed as follows, for example.

Firstly, the valve retaining member 11 is appropriately positioned, and then arranged on the valve seats 12. Next, a photosensitive resin film is laminated on the valve retaining member 11. At this time, since the valve retaining member 11 is a thin plate member with a thickness of approximately 5 μm, the photosensitive resin film falls into the holes 18, and is brought into contact with the valve seats 12. Then, a photomask is provided on the laminated photosensitive resin film, and then portions to be left as the adhesion columns 13 are irradiated with ultraviolet rays. After that, the photosensitive resin film is developed with a developer consisting of a mixture of xylene and butylcellosolve acetate, and thereby an unexposed portion is caused to melt. As a result of this, the portions exposed and cured are left on the valve retaining member 11, and thus these portions become the adhesion columns 13 which are joined to the valve seats 12 through the holes 18. Thereafter, by curing the adhesion columns 13 at a temperature of approximately 100° C., the valve retaining member 11 and the valve seats 12 are joined to each other, and thus, the adhesion of the valve retaining member 11 is completed.

Here, in this embodiment, the valve retaining member 11 and the valve seats 12 are joined by using the adhesion columns 13 that are formed at constant intervals. The arrangement positions and the number of adhesion columns 13 are appropriately determined such that undesirable warpage or lifting of the valve retaining member 11 is effectively suppressed, and that a predetermined adhesive strength is obtained. The configuration of the valve retaining member 11 in which a plurality of holes 18 are distributed is also preferable from a viewpoint of increasing a degree of freedom of design for the arrangement positions and the number of the adhesion columns 13.

In addition, in this embodiment, the valve seats 12 are formed of the photosensitive resin film simultaneously when the nozzles are formed. Then, the adhesion columns 13 as well are formed by use of the photosensitive resin film in the photolithography process, and thereby are joined to the valve seats 12. Thus, it is possible to secure a highly accurate and stable adhesion state. Moreover, by forming the valve seats 12 and the adhesion columns 13 of the same material, it is possible to avoid an occurrence of an undesirable stress due to thermal influence.

Here, as a comparative example of the present embodiment, a case where the adhesion process is performed by use of an adhesive agent will be described.

Figures 15A, 15B, 15C:
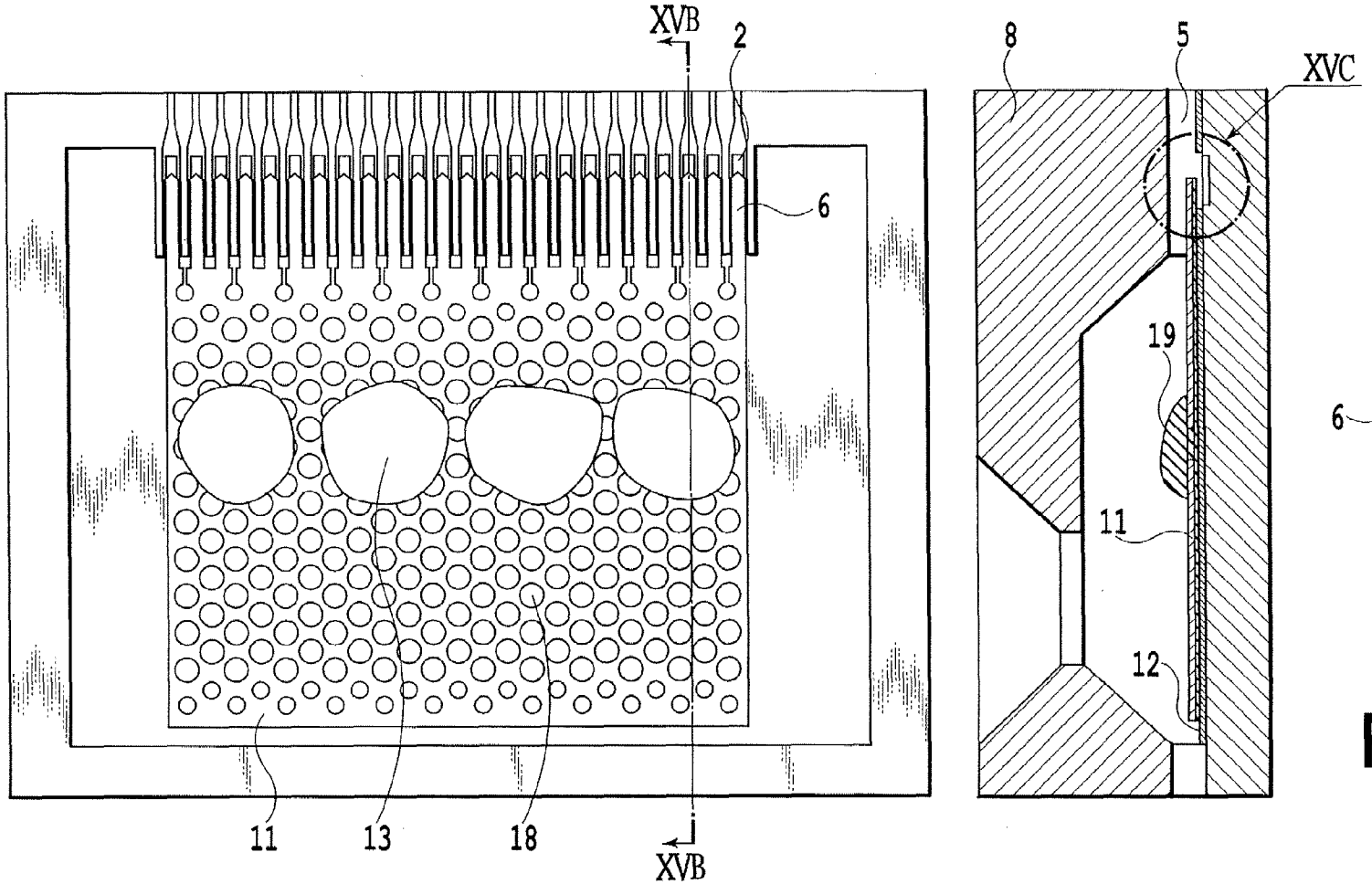
FIG. 15A is a top view showing a printing head according to a comparative example in a state where a top plate is removed therefrom.
FIG. 15B is a cross sectional view of the printing head taken along the line XVB-XVB of FIG. 15A.
FIG. 15C is an enlarged view of the portion XVC of FIG. 15B.

FIG. 15A is a top view showing a printing head according to the comparative example in a state where a top plate is removed therefrom. FIG. 15B is a cross sectional view of the printing head taken along the line XVB-XVB of FIG. 15A. FIG. 15C is an enlarged view of the portion XVC of FIG. 15B.

In this comparative example, a valve retaining member 11 and valve seats 12 are connected to each other with adhesive agent 19 applied thereto at constant intervals. The adhesive agent is liquid thermoset epoxy, and is applied to the top surface of the valve retaining member 11 by a metering discharge device (a dispenser). The coated adhesive agent 19 flows out towards the valve seats 12 from the holes 18 of the valve retaining member 11, and further spreads out in the interface between the valve retaining member 11 and the valve seats 12 due to capillarity. Thereafter, by causing the adhesive agent 19 to be cured by heating, the valve retaining member 11 and the valve seats 12 are joined to each other.

Here, the adhesive agent 19 spreading out the entire interface between the valve retaining member 11 and the valve seat 12 shrinks at the time of cooling after heating. Accordingly, a stress is generated between the adhesive agent 19 and the valve seat 12. Thus, the stress may adversely affect the attachment accuracy the valve retaining member 11. In addition to this, in an extreme case, the valve seats 12 cannot bear the stress, and thereby a fine crack may occur in the valve seats 12.

Such a crack possibly occurs not only when the printing head is manufactured, but also when the printing head is used. As described above, in high speed printing operations, the heaters 2 are driven at high frequency, and the movable valves 6 are moved from and returned to the original positions at high frequency. The vicinity of the heater board becomes in a high temperature environment. In addition, since the materials of the valve seats 12 and the adhesive agent 19 which fixates the valve retaining member 11 are different, linear expansion coefficients thereof are naturally different from each other. Thus, particularly in high speed printing operations, the amounts of elongations of the adhesive agent 19 and the valve seats 12 by heating are different, a stress is generated at contacting surfaces of the adhesive agent 19 and the valve seats 12. When this stress increases, a fine crack may occur in the valve seats 12.

When such a crack occurs, the wirings for electricity conduction or the like disposed on the bottom surface of the valve seats 12 are brought into contact with ink. As a result, a short circuit occurs in the wirings via the ink. Thus, an ejection failure, and eventually, a reduction in the quality of a formed image occur.

Furthermore, when the dispenser is used for applying a constant amount of an adhesive agent to desired positions, an adhesive ejection portion of the dispenser needs to move over the entire area including application points. During the period from the initial application to the end, the adhesive agent starts flowing out sequentially from the application points to the periphery thereof immediately after the start of the application, and then, the adhesive agent may reach the vicinities of the nozzles. Accordingly, when the adhesive agent on the vicinities of the nozzles is cured by heating in a later process, the movables valves 6 are firmly fixed. This does not allow the movable valves 6 to desirably change their positions, and may result in failure of achieving the desired objects for arranging the movable valves 6.

As described above, in a case where the valve retaining member 11 is adhered to the valve seats 12 by applying a liquid adhesive agent, it is not possible to strictly control the shapes of adhered portions, so that various problems attributable to this factor occur. In contrast to this, in the case of the aforementioned embodiment, the valve retaining member is adhered to the substrate in good conditions, and desired attachment accuracy can be secured and maintained. Furthermore, since it is not necessary to take the spreading out of an adhesive agent into consideration, a degree of freedom for setting adhesion points increases. Thus, it is possible to obtain stable adhesion state of the valve retaining member 11 without warpage or lifting.

It should be noted that, although each of the adhesion columns has a cylindrical shape with a cross sectional circular form as it is obvious from FIG. 14A in this embodiment, the shape thereof can be determined appropriately as a matter of course.

Figure 16:
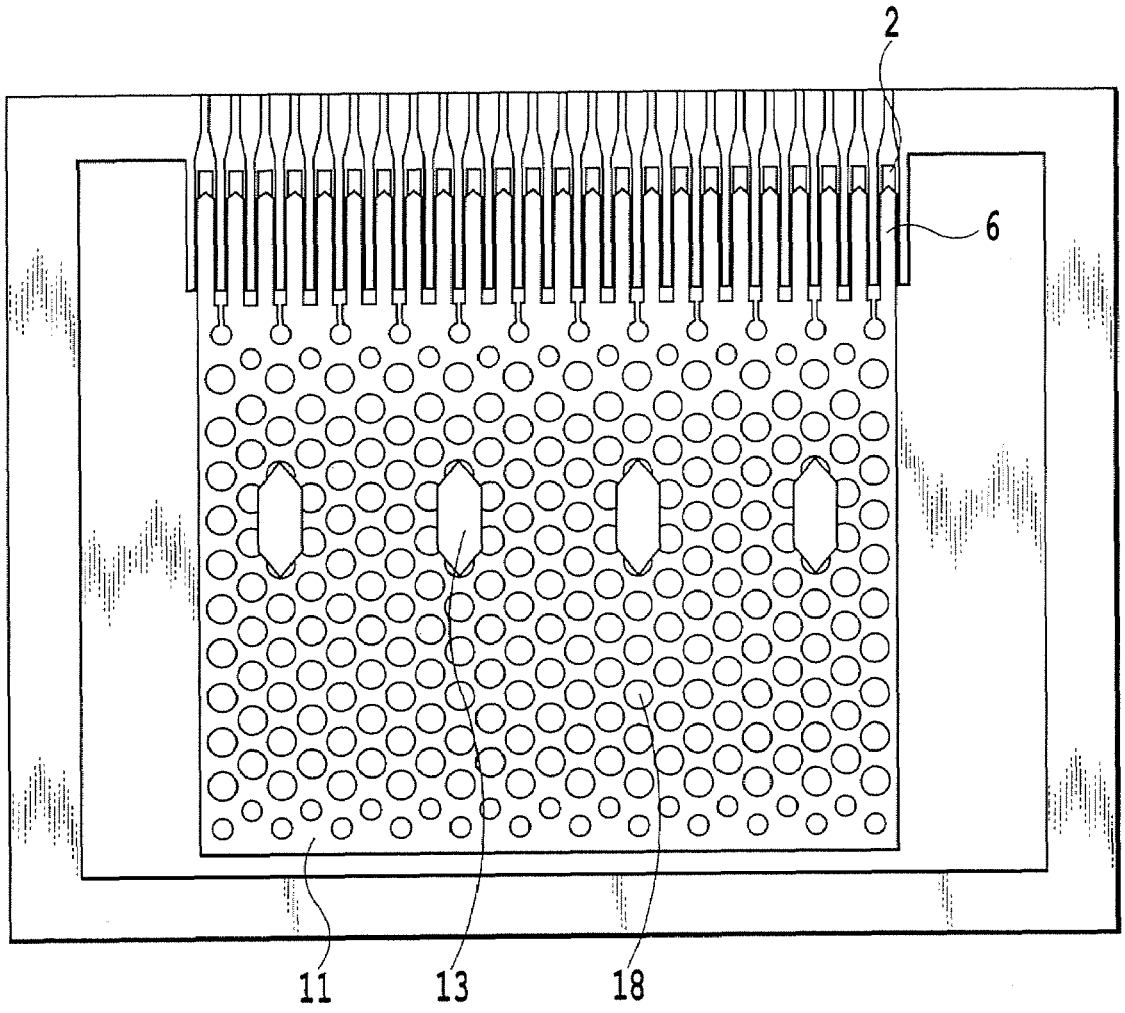
FIG. 16 is a top view showing a printing head according to another embodiment in a state where a top plate is removed therefrom.

FIG. 16 shows an embodiment in which each adhesion column 13 has a hexagonal cylindrical shape with a cross sectional hexagon. Here, in this hexagon, the length a perpendicular to a nozzle arrangement direction is longer than the length b in the nozzle arrangement direction. By designing such a shape, resistance to the flow of ink towards the nozzles from the common liquid chamber is reduced, and it is possible to prevent ink refilling performance from deteriorating. Moreover, the hexagonal column shape is not a requirement for this purpose, and rather, needless to say, other shapes, for example, an ellipse column, or other polygonal columns can be employed.

Moreover, in the aforementioned embodiment, the adhesion columns 13 are formed by use of the holes 18 being distributed in the valve retaining member 11 for suppressing the vibrational components, and for reducing the influence of thermal expansion. The present invention, however, is not the one that can be applied only to such a structure of the valve retaining member. Specifically, the present invention can be applied to any structure in which holes appropriate for forming adhesion columns are formed.

Furthermore, the process for forming adhesion portions is not limited to the aforementioned one. Any photolithography process can be applied as long as the process makes it possible to preferably form adhesion portions joined to the valve seats 12 through the holes 18 from the top surface of the valve retaining member. In addition, an application of the photolithography process by use of a photosensitive resin material is not necessarily a requirement for forming adhesion portions. For example, when a material is used which is different from that of the valve seats, but which has a thermal expansion coefficient equal to that of the valve seat, an undesirable stress due to thermal influence does not occur. For this reason, it is possible to form adhesion portions by applying such a material by spraying from the top surface side of the valve retaining member 11, for example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An inkjet printing head comprising:

a substrate including a heater for causing thermal energy used for ejecting ink from a nozzle to act on the ink; and a valve retaining member including a movable valve which is provided corresponding to the nozzle, and which is capable of changing its position in response to generating a bubble in the ink accompanying the action of the thermal energy caused by the heater, wherein the substrate includes a seat to which the valve retaining member is attached, the valve retaining member includes a plurality of holes distributed on the valve retaining member and penetrating from a bottom surface attached to the seat, and to a top surface opposite the bottom surface, the valve retaining member is fixed to the substrate by adhesion portions formed by attaching a material having a thermal expansion coefficient equal to that of the seat so that the material is joined to the seat by passing through the hole from the top surface, and each adhesion portion is formed through multiple holes of the plurality of holes.

2. An inkjet printing head as claimed in claim 1, wherein the adhesion portion is formed by using a photolithography process.

3. An inkjet printing head as claimed in claim 1, wherein the seat and the adhesion portion are made of the same material.

4. An inkjet printing head as claimed in claim 1, further comprising:

a plurality of the nozzles arranged therein; and a liquid chamber for supplying ink with which the plurality of nozzles commonly communicate, wherein the valve retaining member is attached to the seat while facing the liquid chamber, and a dimension of the adhesion portion in an arrangement direction of the nozzles at the top surface of the valve retaining member is smaller than a dimension in a direction perpendicular to the arrangement direction.

* * * * *